US010676932B2

(12) United States Patent
Miller, Jr. et al.

(10) Patent No.: US 10,676,932 B2
(45) Date of Patent: Jun. 9, 2020

(54) LEAF GUTTER GUARD

(71) Applicant: A-M SEAMLESS GUTTERS, LLC, Burton, OH (US)

(72) Inventors: Raymond R. Miller, Jr., Burton, OH (US); Aden R. Miller, Windsor, OH (US)

( * ) Notice: Subject to any disclaimer, the term of this patent is extended or adjusted under 35 U.S.C. 154(b) by 0 days.

(21) Appl. No.: 16/247,200

(22) Filed: Jan. 14, 2019

(65) Prior Publication Data

US 2019/0218782 A1 Jul. 18, 2019

Related U.S. Application Data

(60) Provisional application No. 62/617,891, filed on Jan. 16, 2018.

(51) Int. Cl.
*E04D 13/076* (2006.01)
*E04D 13/072* (2006.01)

(52) U.S. Cl.
CPC ..... *E04D 13/076* (2013.01); *E04D 13/0725* (2013.01)

(58) Field of Classification Search
CPC ..... E04D 13/076
USPC ..... 52/12
See application file for complete search history.

(56) References Cited

U.S. PATENT DOCUMENTS 4,937,986 A * 7/1990 Way, Sr. ..... E04D 13/076 210/474
5,109,640 A * 5/1992 Creson ..... E04D 13/076 210/474
7,950,187 B2 * 5/2011 Iannelli ..... E04D 13/076 210/162
D651,292 S 12/2011 Geers
D672,016 S * 12/2012 Walker ..... D23/267
8,434,269 B1 * 5/2013 Brochu ..... E04D 13/076 52/12
8,578,658 B2 11/2013 Snell
8,650,803 B2 * 2/2014 Robins ..... E04D 13/076 248/48.1
8,776,444 B2 * 7/2014 Beck ..... E04D 13/076 52/12
9,127,463 B1 * 9/2015 Feldhaus ..... E04D 13/0725
9,394,694 B2 7/2016 Iannelli
9,422,722 B2 * 8/2016 Iannelli ..... E04D 13/064
10,100,522 B2 * 10/2018 Beck ..... E04D 13/076
10,519,668 B1 * 12/2019 Bachman ..... E04D 13/076
(Continued)

FOREIGN PATENT DOCUMENTS

CA 2723499 A1 * 3/2011 ..... E04D 13/076
CA 02783834 * 7/2012 ..... E04D 13/076
(Continued)

*Primary Examiner* — Robert Canfield
(74) *Attorney, Agent, or Firm* — Fay Sharpe LLP

(57) ABSTRACT

The present disclosure relates to gutter systems and gutter covers that prevent preventing debris from falling into and clogging a gutter. The gutter cover includes a longitudinally extending body having a front end and a rear end, a generally planar front portion and a generally planar rear portion. The gutter cover also includes a middle portion disposed between the front portion and the rear portion, the middle portion including a longitudinally extending first ridge. The first ridge is contoured to avoid contact with a mounting bracket of the gutter system.

10 Claims, 6 Drawing Sheets

(56) References Cited

U.S. PATENT DOCUMENTS

| | | | | |
|---|---|---|---|---|
| 2007/0012845 | A1* | 1/2007 | Iannelli | E04D 13/076 248/312.1 |
| 2008/0190040 | A1* | 8/2008 | Graves | E04D 13/076 52/12 |
| 2009/0031638 | A1* | 2/2009 | Iannelli | E04D 13/076 52/12 |
| 2011/0041414 | A1 | 2/2011 | Bell | |
| 2011/0138697 | A1 | 6/2011 | Martin | |
| 2011/0162289 | A1* | 7/2011 | Cangialosi | E04D 13/076 52/12 |
| 2011/0185641 | A1* | 8/2011 | Snell | E04D 13/076 52/12 |
| 2011/0265391 | A1* | 11/2011 | Robins | E04D 13/0725 52/12 |
| 2012/0151849 | A1* | 6/2012 | Brochu | E04D 3/364 52/12 |
| 2012/0186163 | A1* | 7/2012 | Walker | E04D 13/076 52/12 |
| 2012/0272586 | A1* | 11/2012 | Beck | E04D 13/076 52/12 |
| 2013/0091780 | A1* | 4/2013 | Robins | E04D 13/076 52/12 |
| 2015/0020462 | A1* | 1/2015 | Iannelli | E04D 13/064 52/12 |
| 2018/0274239 | A1* | 9/2018 | Cullen | E04D 13/076 |

FOREIGN PATENT DOCUMENTS

| | | | | |
|---|---|---|---|---|
| GB | 2084210 | A * | 4/1982 | E04D 13/076 |
| WO | WO-2015048116 | A1 * | 4/2015 | E04D 13/076 |

* cited by examiner

LEAF GUTTER GUARD

CROSS-REFERENCE TO RELATED APPLICATIONS

This application claims priority to U.S. Provisional Patent Application Ser. No. 62/617,891, filed Jan. 16, 2018, and U.S. patent application Ser. No. 29/629,440 filed Dec. 13, 2017 the entireties of which are incorporated by reference herein.

BACKGROUND

The present disclosure relates to gutter systems for roofing applications. It finds particular application in conjunction with gutter covers and preventing debris such as leaves from falling into and clogging a gutter and will be described with particular reference thereto. However, it is to be appreciated that the present exemplary embodiment is also amenable to other like applications.

Gutters and downspouts are mounted on most residential and commercial structures along the lower edge of the roof of the structure. The gutters collect water runoff and direct the runoff away from the structure, usually to a downspout. Gutters come in many different styles, but all are generally formed with an open top and upright sidewalls. Leaves and other debris, may fall and accumulate in the gutter and hinder the gutter's ability to direct the runoff away from the structure. A gutter that becomes impeded by leaves can cause water to overflow before reaching the downspout. Water spillage can cause damage to the building's structure and/or landscaping. Removal of the leaves and debris from the roof is often a labor-intensive task that can include the hazard of working above ground.

Some gutter systems are mounted to the structure by a plurality of spaced apart screws and ferrules. The screw is threaded through the front and rear sidewalls of the gutter and into the fascia of the building. A ferrule is placed over the screw between the front and rear sidewalls. Other gutter systems are mounted to the structure by a plurality of spaced apart hangers. Each hanger in a hanger system includes a fastener that attaches the rear sidewall of the gutter to the structure's fascia and a hook portion that engages a front lip of the gutter to hold the gutter upright, i.e., the gutter is suspended by the hangers.

Gutter covers, shields, and other protectors may be installed over the gutter to prevent debris and leaves from falling and accumulating into the gutter and impeding the flow of water. Gutter covers come in many different styles and shapes. The shapes of the covers are usually dependent on the gutter size and mounting system employed to connect the gutter to the structure. That is, some gutter covers are incompatible with certain mounting systems. While gutter covers supply a desirable improvement of to the structure's runoff system, they can also be inconvenient to install.

Thus, it is desirable to provide a gutter cover that may be installed or retrofitted to most gutter systems regardless of the mounting system used as well as provide a low-profile design such that a minimal amount of the gutter cover may be seen by observers of the structure.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In accordance with some aspects of the disclosure, a gutter cover includes a longitudinally extending body having a front end and a rear end, a generally planar front portion, and a generally planar rear portion. The gutter cover includes a middle portion disposed between the front portion and the rear portion, the middle portion comprising a longitudinally extending ridge. The gutter cover also includes a plurality of perforations disposed on the longitudinally extending body.

In some embodiments, the gutter cover includes a second ridge disposed on the front portion. The width and height of the first ridge can be greater than the width and height of the second ridge.

In some embodiments, the gutter cover further includes a front gutter interface comprising a vertical wall and a horizontal ledge extending from the front portion. The horizontal ledge may include a plurality of apertures adapted to accommodate fasteners.

In some embodiments, the longitudinally extending first ridge has an asymmetric cross-section.

In some embodiments, the cover further includes a rear wall extending at an obtuse angle relative to the planar rear portion.

BRIEF DESCRIPTION OF THE DRAWINGS

The following description and drawings set forth certain illustrative implementations of the disclosure in detail. The illustrated examples, however, are not exhaustive of the many possible embodiments of the disclosure.

DETAILED DESCRIPTION

Figure 1A:
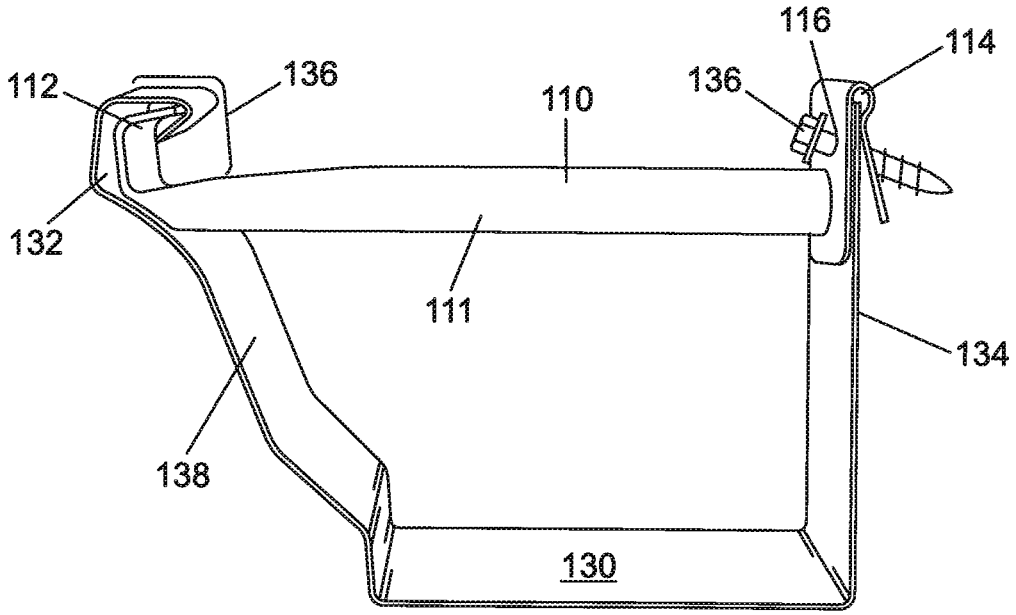
FIG. 1A (PRIOR ART)
FIG. 1A is a cross-sectional view of a prior art straight hanger gutter system.
Figure 1B:
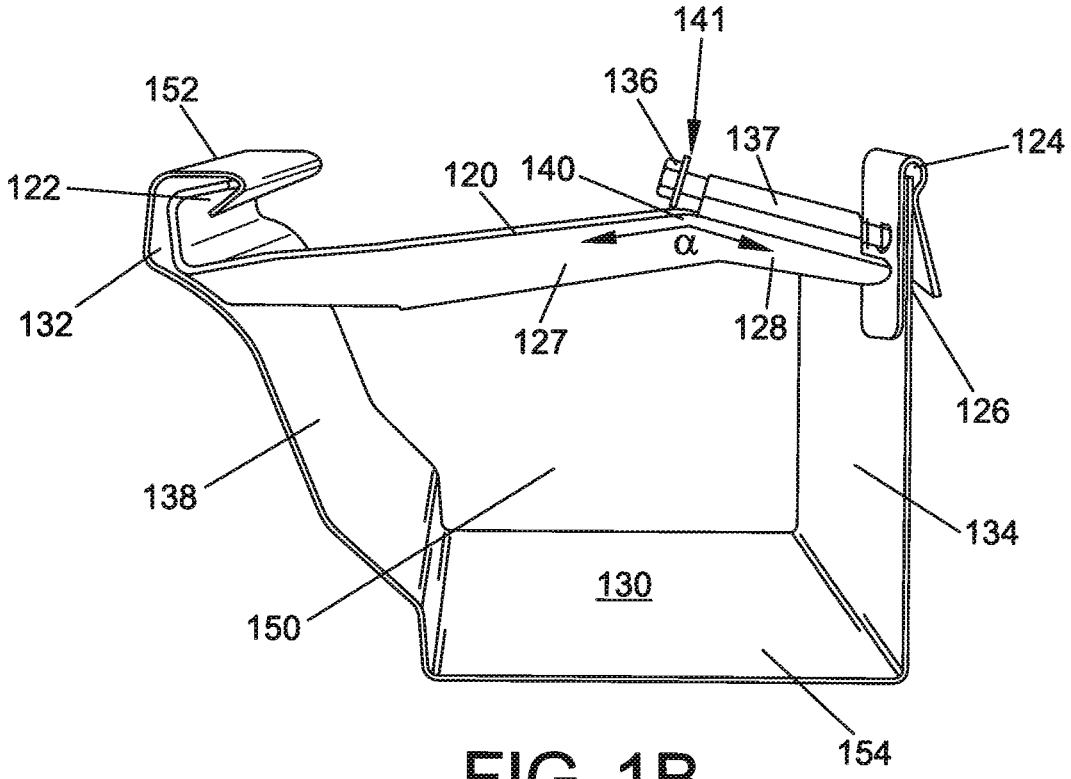
FIG. 1B (PRIOR ART)
FIG. 1B is a cross-sectional view of a prior art angled hanger gutter system.

FIG. 1A and FIG. 1B illustrate common gutter assemblies that are attached to a structure. FIG. 1A illustrates use of a straight hanger 110 and FIG. 1B illustrates use of an angled hanger 120 used for attaching a gutter 130 to a structure. The gutter hangers 110 and 120 provide a mounting device for attaching the gutter 130 to the fascia of a structure. Gutters 130 typically include a front cavity 132 for accepting and securing a front head 112, 122 of a gutter hanger 110, 120.

In some cases, such as those illustrated in FIG. 1A and FIG. 1B, the front cavity 132 of the gutter 130 and front heads 112, 122 of the hangers 110, 120 are matched in shape. That is, the cavity 152 and front head 112, 122 may be curved, for example, having a C-shaped cross-section. In this way, the front head 112, 122 of the hanger 110, 120 can engage the cavity 132 of the gutter 130.

During installation of the gutter 130 to the structure, the hanger 110, 112 is manipulated such that the hanger's front head 112, 122 is situated inside and engaged with the front cavity 132 of the gutter 130. This front engagement keeps the front wall 138 of the gutter 130 in a relatively fixed position with respect to the structure. However, not all straight hangers 110 in a straight hanger system employ a head that engages a gutter cavity 132. In some embodiments, a straight hanger is simply bolted through both the front wall 138 and rear wall 134 of the gutter 130 and attached to the structure's fascia.

As illustrated in FIG. 1A he straight hanger 110 includes a single body segment 111. FIG. 1B, illustrates an angled hanger 120 including at least two body segments, a front body segment 127 adjacent to the front head 122 and a rear body segment 128 adjacent to the rear clip 124. The front and rear body segments, 127 and 128, of the angled hanger 120 are joined at a joint 140. In some embodiments, the joint 140 is located slightly more towards the rear clip 124 than the front head 122. The front and rear body segments 127 and 128 extend from one another at joint 140 at an angle $\alpha$. Generally, the angle $\alpha$ is an obtuse angle. The rear body segment 128 usually includes a fastener guide 137 that accommodates a fastener 136. The fastener guide 137 is generally a tubular shape adapted to receive a portion of a fastener, for example and without limitation, nails, screws and bolts. In some embodiments, the fastener 136 inserts through the fastener guide 137 such that the fastener 136 secures the hanger 120 to the structure. The joint 140 between the front and rear body segments 127, 128 along with the fastener guide 137 and fastener 136 create bulge portion with a peak 141.

The rear end of a hanger 110, 120 may include a rear clip 114, 124. The rear clip 114, 124 is generally in the shape of a fold with an open end configured to engage a rear edge 134 of the gutter 130. In some embodiments, an aperture 116, 126 is present in the rear clip 114, 124 that allows the fastener 136 access to the structure. Once the curved front head 112, 122 is engaged with the curved cavity 132, the rear edge 134 of the gutter 130 is placed within the rear clip 114, 124 of the hanger. The fastener 136 may pierce through the hanger aperture 116, 126, such that rear gutter wall 134 and structure to secure the hanger 110, 120 and gutter 130.

Figure 2A:
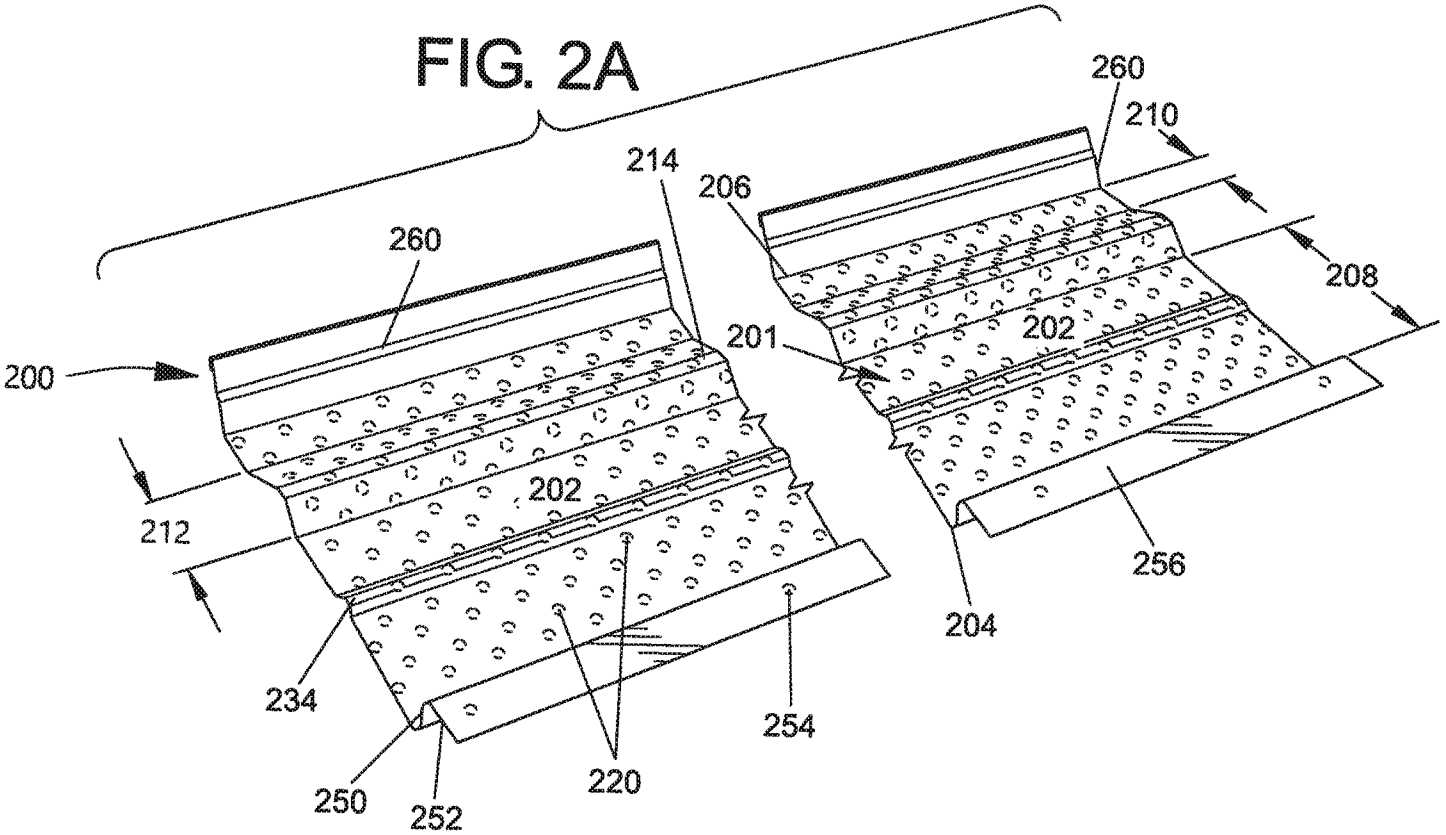
FIG. 2A is a perspective view of an exemplary gutter cover in accordance with the present disclosure.
Figure 2B:
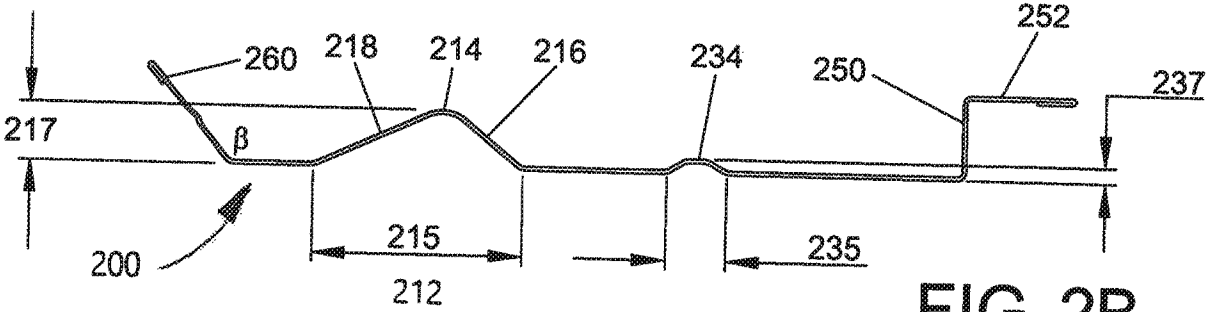
FIG. 2B is a cross-sectional view of an exemplary gutter cover in accordance with the present disclosure.

In accordance with some aspects of the present disclosure and with reference to FIGS. 2A and 2B, a gutter cover 200 is provided. The gutter cover 200 includes a longitudinally extending body 202 having a front end 204, a rear end 206, and a top surface 201. The longitudinally extending body 202 has a generally planar front portion 208 associated with the front end 204. The longitudinally extending body 202 also includes a generally planar rear portion 210 associated with the rear end 206. Disposed between the planar front portion 208 and planar rear portion 206 is a middle portion 212. The middle portion 212 includes a longitudinally extending first ridge 214.

The longitudinally extending first ridge 214 is able to suspend debris above the cover 200 such that air can flow between the debris and cover and subsequently dry and remove the debris. The longitudinally extending first ridge 214 also enhances the structural rigidity of the cover 200. That is the first ridge 214 stiffens the cover 200 such that the cover may support accumulated debris, ice and snow without significant bending or warping. As illustrated in the side cross-sectional view of the exemplary embodiment of FIG. 2B, the first ridge 214 is defined by a base width 215 and first height 217.

Figure 3A:
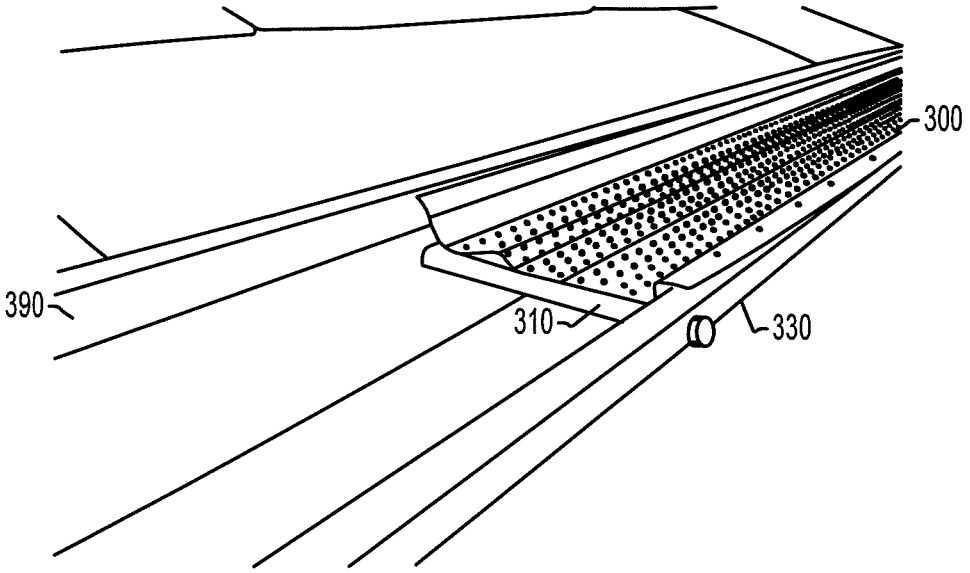
FIG. 3A is a photograph illustrating a gutter cover in accordance with the present disclosure installed on a straight hanger gutter system.

The gutter cover of the present disclosure is a true universal cover, unlike other conventional gutter covers. Specifically, the gutter cover is compatible with straight hanger gutter systems, illustrated in FIG. 3A and angled hanger gutter systems, illustrated in FIG. 3B. FIG. 3A shows a gutter cover 300 supported by a gutter 330 and straight gutter hanger 310. It is noted that the cover 300 is compatible with the straight hanger gutter system. That is, no additional modifications to the gutter system of FIG. 3A are needed to accommodate the gutter cover 300.

Figure 3B:
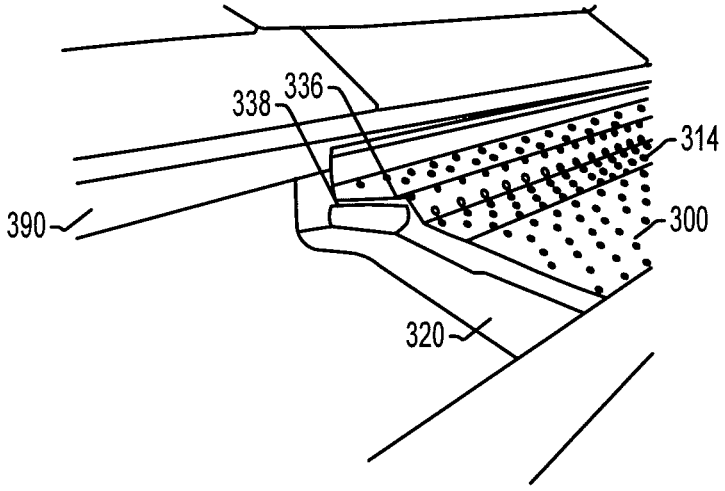
FIG. 3B is a photograph illustrating a gutter cover in accordance with the present disclosure installed on an angled hanger gutter system.

FIG. 3B shows the gutter cover 300 installed to an angled hanger gutter system. That is, the gutter 330 is attached to the fascia 390 of a structure via an angled hanger 320. In some embodiments, the longitudinally extending first ridge 314 of the cover 300 mimics the contour of the gutter hanger 322. In this way, the fastener 336 and fastener guide 338 the hanger 320 are prevented from contacting and damaging the gutter cover 300. Thus, like the straight hanger system of FIG. 3A, no additional modifications to the gutter system 330 are needed to accommodate the gutter cover 300.

Other conventional gutter covers may contact the fastener, such as fastener 136, or other parts of an angled hanger system. Over time the fastener 136 and fastener guide 137 may contact, rub, pierce or otherwise wear and damage the conventional gutter cover prompting a need for a replacement cover, for either cosmetic or functional reasons.

In accordance with another aspect of the present disclosure and illustrated in FIG. 2B, the first longitudinally extending ridge 214 has an asymmetric cross-section. That is, the longitudinally extending ridge 214 includes a longitudinally extending front wall 216 and a longitudinally extending rear wall 218 wherein each wall 216 and 218 are of different lengths and are angled with respect to the longitudinally extending planar at different angles. For example and without limitation, the longitudinally extending front wall 216 is angled at an interior angle $\omega$ with respect to the longitudinally extending planar front portion 208 and the longitudinally extending rear wall 218 is angled at an interior angle $\varphi$ with respect to the longitudinally extending rear portion 210. In some embodiments, angle $\omega$ is greater than angle $\varphi$. The asymmetric cross-section of the ridge 214 provides enhanced airflow for drying debris that may accumulate on the cover 200.

In some exemplary embodiments and with reference to FIG. 2A, the gutter cover 200 includes a plurality of perforations 220 disposed on the longitudinally extending body 202. The plurality of perforations 220 creates a mesh-like surface through which fluids, such as water and air, are permitted to pass while preventing debris from entering the trough of a gutter. The density of the plurality of perforations 220 (the size and amount per square area) must be sufficient to prevent flooding of the cover 200 and overflow of the cover 200 while providing adequate surface flow to clear debris from the top surface 201 of the cover 200. In some embodiments, the plurality of perforations is about 350 perforations per longitudinal foot. In other embodiments, the plurality of perforations 220 is greater than 350 perforations per longitudinal foot. The plurality of perforations 220 also allows air to flow through and around debris captured by the gutter cover 200. The air flow dries the debris and enables wind to blow the debris off of the cover 200 keeping the surface 201 of the gutter cover 200 clean.

Figure 4:
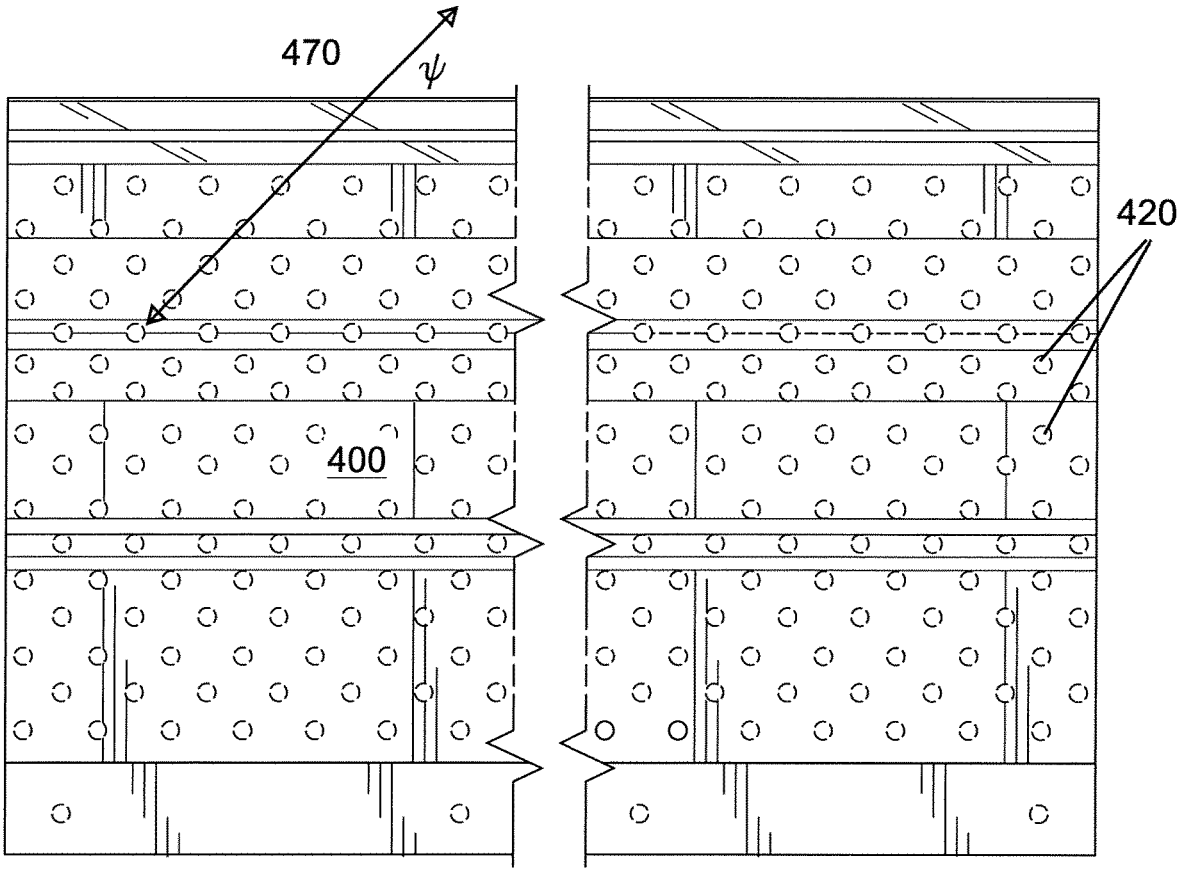
FIG. 4 is a top elevational view of an exemplary gutter cover in accordance with the present disclosure.

In some embodiments and illustrated the exemplary embodiment of FIG. 4, the plurality of perforations 420 are disposed on the gutter cover 400 with the center of each perforation located about a line 470 angled at a 45-degree angle ψ with respect to an edge of the gutter cover 400. This arrangement provides a template for cutting the gutter cover 400 at 45-degree angles to accommodate corner sections of a gutter system. That is, during installation an installer may cut along a line of perforations and without measurement, create a cut that is angled at about 45 degrees. Cutting gutter covers at opposing 45-degree angles allows for the opposing cut sections to abut and form a 90-degree joint. The 90-degree joint provides protection of the gutter installed about a corner of a structure.

In some exemplary embodiments and with reference back to FIGS. 2A AND 2B, the gutter cover 200 includes a second ridge 234 disposed on the planar front portion 208. The second ridge 234 imparts similar characteristics to the cover 200 that are provided by the first ridge 214. That is, the second ridge 234 provides another structure to prevent debris from lying flat on the planar surface facilitating the drying and removal of such debris. The second ridge 234 also provides enhanced structural stiffness to the cover 200 such that the cover 200 better resists warping and bending. As illustrated in FIG. 2B, the second ridge 234 is defined by a second base width 235 and a second height 237. In some exemplary embodiments, the second ridge 234 is smaller than the first ridge 214, meaning the second base width 235 and second height 237 are less than the first ridge base width 215 and first height 217, respectively.

In some embodiments and with reference to FIGS. 2A-2B, the gutter cover 200 includes a front vertical wall 250 extending from the generally planar front portion 204 to a horizontal ledge 252. The front vertical wall 250 and horizontal ledge 252 form a front gutter interface 256. The front gutter interface 256 is configured to engage a top portion of the front wall of a gutter (element 138 in FIGS. 1A and 1B). In some exemplary embodiments, the horizontal ledge 252 includes a plurality of ledge apertures 254. The ledge apertures 254 are adapted to receive a fastener, for example and without limitation screws, nails, and bolts, for securing the gutter cover 200 to the gutter, such as gutter 130.

In some exemplary embodiments and with reference to FIG. 2A and FIG. 2B, the gutter cover 200 includes a rear wall 260 extending from the rear portion 206. In some embodiments, the rear wall 260 extends at an obtuse angle β relative to the planar rear portion 206. The rear wall 260 is configured to rest against the fascia and/or edge of the structure. The angled rear wall 260 provides a resilient force that urges the front vertical wall 250 to press against the inside top front surface (135 of FIG. 1A) of the gutter 130, such that the cover 200 is secured to the gutter.

The gutter cover 200 is preferably made a lightweight yet durable material able to withstand outdoor environments. That is, the material of the gutter cover 200 is such that the gutter cover does not degrade with exposure to UV light, weather exposure, and temperature cycling. In some embodiments, the gutter cover 200 is made of metal. In some embodiments, the metal is an aluminum-containing metal. In more specific embodiments, the metal is 100% aluminum. In yet more specific embodiments, the gutter cover is made of a heavy gauge 0.018 aluminum.

Figure 5:
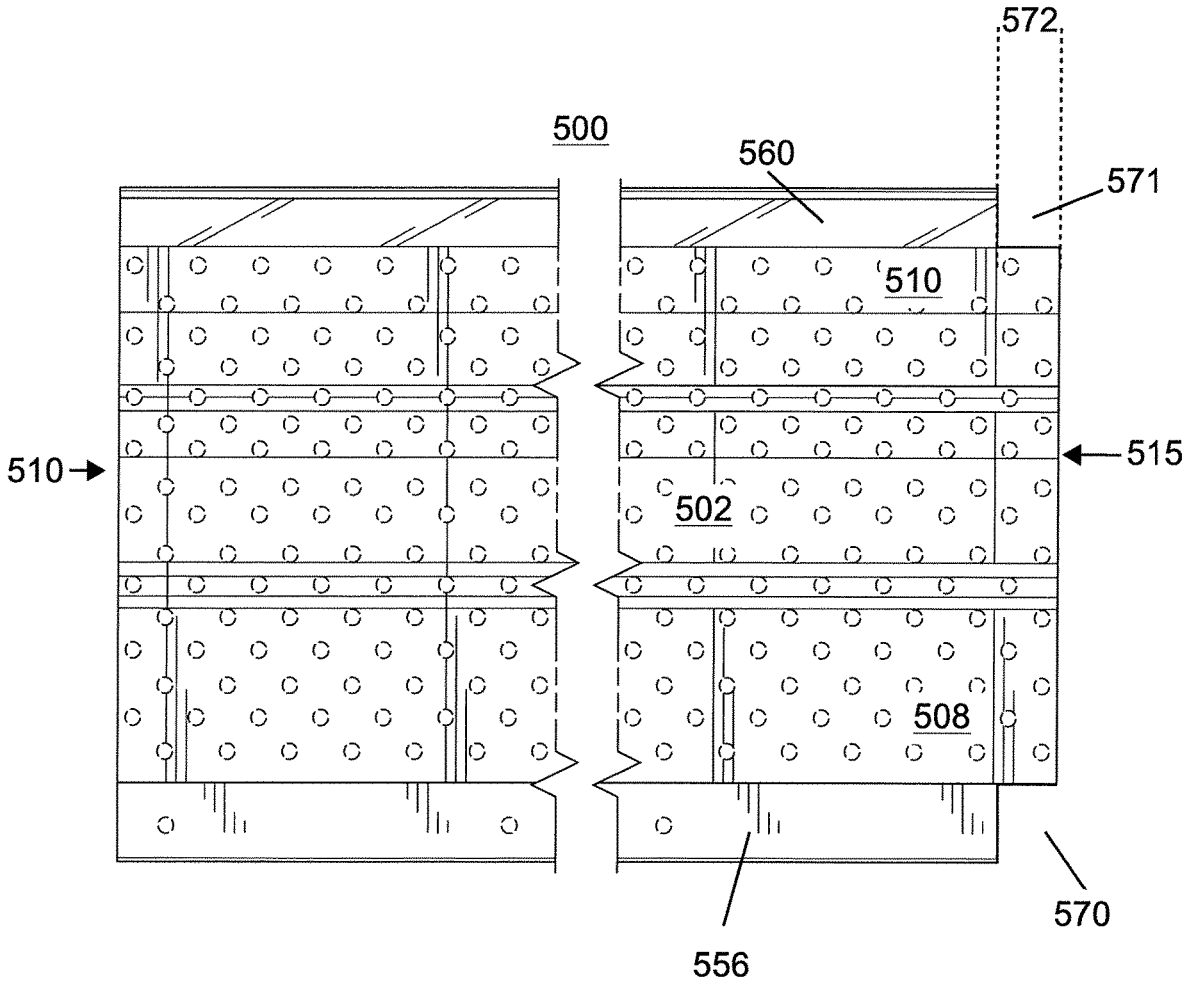
FIG. 5 is a top elevational view of an exemplary gutter cover in accordance with the present disclosure.

In some embodiments and illustrated in the top view of a gutter cover 500 of FIG. 5, the longitudinal body 502 of the gutter cover 500 includes a first end 510, an opposed second end 515, a front gutter interface 556 and rear wall 560. At least one notch, such as the exemplary notch 570, is located adjacent to at least one of the ends 510, 515 of the gutter cover 500. While a singular notch 570 is generally illustrated and described with respect to the second end 515, it is to be appreciated that multiple notches may be located on either or both the first end 510 and second end 515.

In some embodiments, a notch, such as exemplary notches 570 and 571 of FIG. 5, is disposed in at least one of the front gutter interface 556 and the rear wall 560 along the second end 515. In some embodiments, the notch 570, 571 does not extend into the planar body portions 508 and 510. In other embodiments, the notch 570, 571 encroaches into the planar body portions 508 and 510.

In some embodiments and illustrated in FIG. 5, two notches 570 and 571 are present along an end of the gutter cover 500, such as end 515. The notches 570 and 571 allow for continuous coverage of the gutter between adjacent cover guard pieces as notches 570, 571 create a jutted body portion 572 which, as explained in greater detail below with respect to FIGS. 6A AND 6B, overlaps and may rest on or beneath a longitudinal body of an adjacent cover. Stated another way, the jutted body portion 572 extends from the longitudinal body 502 beyond the ends of the front gutter interface 556 and rear wall 560. The notched portions 570 and 571 of the front gutter interface 556 and rear wall 560 of one gutter cover about the unnotched portions of an adjacent gutter cover. In some embodiments, the covers include a plurality of perforations that accommodate a fastener adapted to secure the adjacent cover guards to each other.

Figures 6A, 6B:
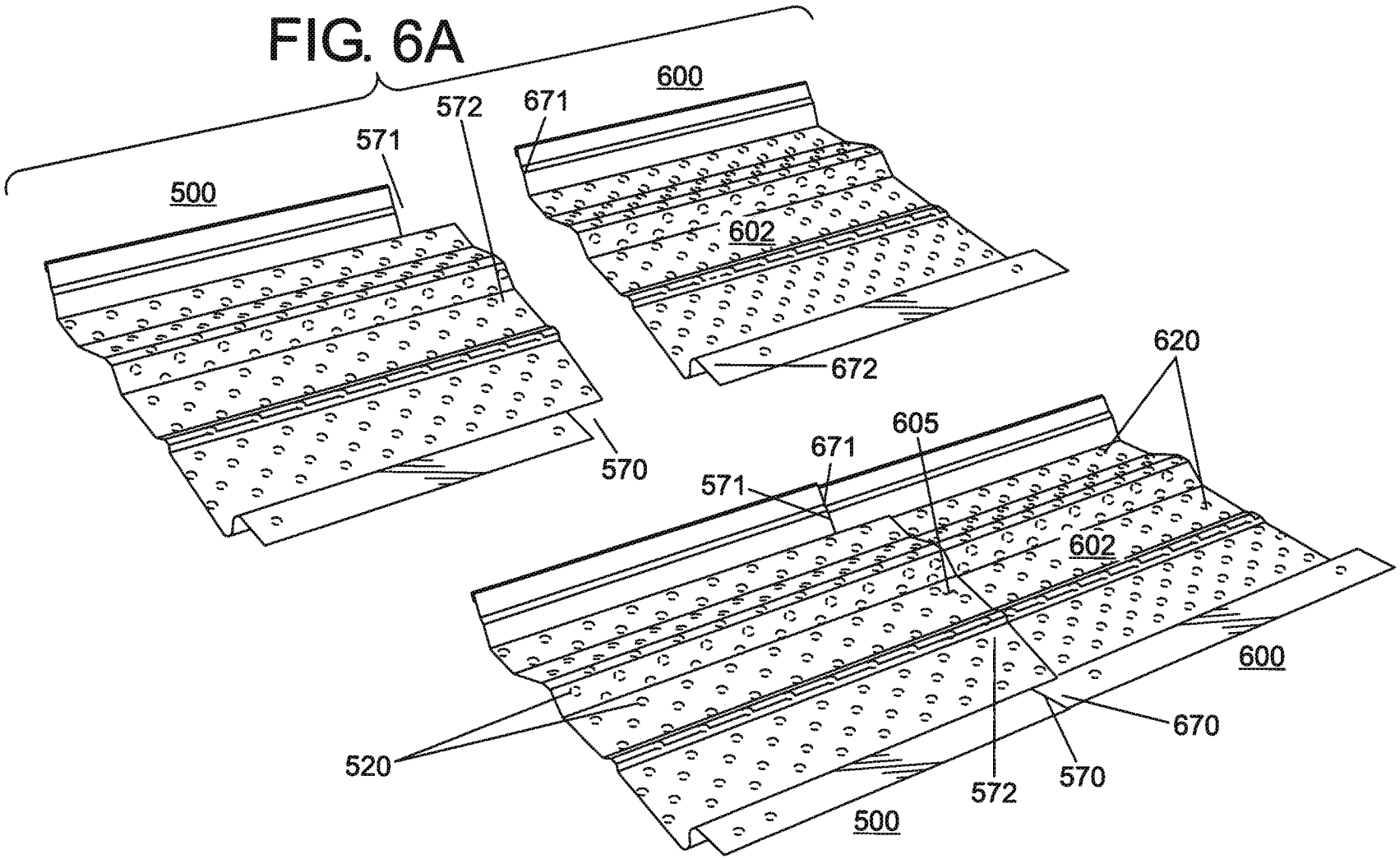
FIG. 6A is a perspective view of separated exemplary gutter covers in accordance with the present disclosure.
FIG. 6B is a perspective view of joined exemplary gutter covers in accordance with the present disclosure.

FIGS. 6A and 6B illustrate a first gutter cover 500 a second gutter cover 600 in a separated position and joined position, respectively. When joining the two gutter covers 500 and 600, the jutted portion 572 of the first cover 500 overlaps the longitudinal body 602 of the second gutter cover 600. The notched portions 570 and 571 of the front gutter interface 571 and rear wall 560, respectively, of the first gutter cover 500 abut the unnotched portions 670 and 671, respectively, of the second gutter cover 600.

In some embodiments, a fastener 605, for example and without limitation a screw, nail, and bolt, fastens the jutted portion 572 of the first gutter cover to the longitudinal body 602 of the second gutter cover 600. In some embodiments, the fastener 605 passes through one of the plurality of perforations 520 of the first cover 500 and one of the plurality of perforations 620 of the second cover 600 securing the first cover 500 to the second cover 600.

In some embodiments, a gutter cover includes jutted portions, such as jutted portion 572, extending from both the first end 510 and second end 515.

In accordance with another aspect of the present disclosure, a gutter system is provided. With reference to FIG. 1, the gutter system includes a gutter 130 having a top 152, a bottom wall 154, a front sidewall 138 and a rear sidewall 134 defining a longitudinally extending through 150. At least one bracket 120 mounts the gutter 130 to a structure via a fastener 136. The system also includes a gutter cover described in any embodiment above, such as gutter covers 200, 300, 400, 500, and 600, positioned on the top of the gutter 130.

In some embodiments, the gutter system further includes a gutter cover including one of or both of a longitudinally extending first ridge and second ridge analogous to the first ridge 214 and the second ridge 234 of FIG. 2B.

In some embodiments, the gutter system further includes at least one additional gutter cover, the at least one additional gutter cover analogous to gutter covers 200, 300, 400, 500, and 600.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

The invention claimed is:

1. A gutter cover comprising:

a longitudinally extending body having a front end and a rear end, a generally planar front portion adjacent to the front end;

a generally planar rear portion adjacent to the rear end;

a middle portion, disposed between the front portion and the rear portion, the middle portion including a longitudinally extending first ridge having an asymmetric cross-section and the front portion including a longitudinally extending second ridge wherein a first width and a first height of the longitudinally extending first ridge is greater than a second width and a second height of the longitudinally extending second ridge;

a plurality of perforations disposed on the longitudinally extending body;

a front gutter interface configured to engage a front wall of a gutter wherein the front gutter interface comprises a plurality of apertures, said apertures adapted to accommodate a fastener for securing the gutter cover to the front wall of the gutter; and a rear wall extending at an obtuse angle from the planar rear portion.

2. The gutter cover according to claim 1, wherein the gutter interface comprises a vertical wall, that extends from the generally planar front portion to a top horizontal ledge.

3. The gutter cover of claim 1, wherein the longitudinally extending body further comprises a first end and a second end, wherein at least one of the first end and second end includes at least one notch disposed in a corner of at least one of the front gutter interface and the rear wall.

4. The gutter cover of claim 3, further comprising a second gutter cover adjacent to the gutter cover, the second gutter cover comprising:

a generally planar second cover front portion;

a generally planar second cover rear portion;

a second cover middle portion;

a second cover front gutter interface; and a second cover rear wall, wherein the generally planar front portion, the generally planar rear portion and middle portion overlap the second cover front portion, second cover rear portion, and second cover middle portion, and the notched portion of the gutter cover abuts an unnotched edge of the adjacent cover.

5. The gutter cover according to claim 1, further comprising at least one jutted portion extending from the longitudinally extending body beyond an end of one of the rear wall and front gutter interface.

6. A gutter system comprising:

a longitudinally extending gutter having a bottom, a front sidewall and a rear sidewall defining a trough;

at least one hanger, the hanger configured to mount the gutter to a structure via an associated fastener; and, a gutter cover positioned on the top of the gutter comprising:

a longitudinally extending body having a front end and a rear end, a generally planar front portion;

a generally planar rear portion;

a middle portion, disposed between the front portion and the rear portion, the middle portion including a longitudinally extending first ridge having an asymmetric cross-section;

a longitudinally extending second ridge disposed on the front portion of the gutter cover, said second ridge having a second ridge width and a second ridge height, a width and a height of the first ridge being greater than the second ridge width and the second ridge height, respectively;

a plurality of perforations in the longitudinally extending body; and, wherein the longitudinally extending body further comprises a first end and a second end, wherein at least one of the first end and the second end includes a jutted body portion extending beyond one of an end of a front gutter interface and an end of a rear wall.

7. The gutter system of claim 6, wherein the front gutter interface comprises a vertical wall extending from the front portion of the gutter cover to a horizontal ledge, the front gutter interface adapted to engage a top and inside portion of the front sidewall of the gutter.

8. The gutter system of claim 7, wherein the horizontal ledge includes a plurality of apertures adapted to accommodate fasteners.

9. The gutter system of claim 7 further comprising a rear wall extending at an obtuse angle relative to the planar rear portion of the gutter cover.

10. The gutter system of claim 6, further comprising a second gutter cover adjacent to the gutter cover, the second gutter cover comprising:

a generally planar second cover front portion;

a generally planar second cover rear portion;

a second cover middle portion;

a second cover front gutter interface; and a second cover rear wall, wherein the jutted portion of the cover overlaps the second cover front portion, second cover rear portion, and second cover middle portion.

* * * * *